US008585835B2

(12) United States Patent
Sugimoto et al.

(10) Patent No.: US 8,585,835 B2
(45) Date of Patent: Nov. 19, 2013

(54) HIGH-STRENGTH STEEL MACHINED PRODUCT AND METHOD FOR MANUFACTURING THE SAME, AND METHOD FOR MANUFACTURING DIESEL ENGINE FUEL INJECTION PIPE AND COMMON RAIL

(75) Inventors: Koh-ichi Sugimoto, Nagano (JP); Sho-hei Sato, Nagano (JP); Teruhisa Takahashi, Sunto-gun (JP); Goro Arai, Chino (JP)

(73) Assignees: Usui Kokusai Sangyo Kaisha Limited (JP); Shinshu University (JP)

( * ) Notice: Subject to any disclaimer, the term of this patent is extended or adjusted under 35 U.S.C. 154(b) by 25 days.

(21) Appl. No.: 12/998,498

(22) PCT Filed: Oct. 29, 2009

(86) PCT No.: PCT/JP2009/068941

§ 371 (c)(1),
(2), (4) Date: Apr. 27, 2011

(87) PCT Pub. No.: WO2010/050619

PCT Pub. Date: May 6, 2010

(65) Prior Publication Data

US 2011/0209803 A1 Sep. 1, 2011

(30) Foreign Application Priority Data

Oct. 31, 2008 (JP) ..... 2008-282598

(51) Int. Cl.

| | |
|---|---|
| ***C22C 38/46*** | (2006.01) |
| ***C22C 38/48*** | (2006.01) |
| ***C22C 38/50*** | (2006.01) |
| ***C21D 8/10*** | (2006.01) |
| ***C21D 9/14*** | (2006.01) |

(52) U.S. Cl.

USPC ..... 148/335; 148/320; 148/333; 148/334; 148/336; 148/909; 148/654; 148/593; 148/590; 148/519; 148/584

(58) Field of Classification Search

USPC ..... 148/320, 333–336, 909, 654, 593, 590, 148/519, 584

See application file for complete search history.

(56) References Cited

U.S. PATENT DOCUMENTS

2004/0226635 A1 11/2004 Ikeda et al.
2008/0251161 A1* 10/2008 Kashima et al. ..... 148/334

FOREIGN PATENT DOCUMENTS

| | | |
|---|---|---|
| JP | 2004-285430 | 10/2004 |
| JP | 2004-292876 | 10/2004 |
| JP | 2005-120397 | 5/2005 |
| JP | 2007-231353 | 9/2007 |
| JP | 2007-291416 | 11/2007 |
| JP | 2008-56956 | 3/2008 |

OTHER PUBLICATIONS

Machine-English translation of Japanese patent No. 2004-332099, Fujita Nobuhiro et al., Nov. 25, 2004.*

* cited by examiner

*Primary Examiner* — Deborah Yee
(74) *Attorney, Agent, or Firm* — Gerald E. Hespos; Michael J. Porco; Matthew T. Hespos

(57) ABSTRACT

A high-strength steel machined product giving excellent hardenability has a metal microstructure with excellent balance of strength and toughness and high stability of retained austenite. The product is composed of an ultra-high low-alloy TRIP steel having a metal microstructure which contains an appropriate quantity of two or more of Cr, Mo, and Ni, and an appropriate quantity of one or more of Nb, Ti, and V, and having an appropriate value of carbon equivalent; the metal microstructure has a mother-phase structure composed mainly of lathy bainitic ferrite with a small amount of granular bainitic ferrite and polygonal ferrite, and has a secondary-phase structure composed of fine retained austenite and martensite.

13 Claims, 4 Drawing Sheets
(1 of 4 Drawing Sheet(s) Filed in Color)

HIGH-STRENGTH STEEL MACHINED PRODUCT AND METHOD FOR MANUFACTURING THE SAME, AND METHOD FOR MANUFACTURING DIESEL ENGINE FUEL INJECTION PIPE AND COMMON RAIL

BACKGROUND OF THE INVENTION

1. Field of the Invention

The present invention relates to a high-strength steel machined product having excellent hardenability and a method for manufacturing thereof, and to a method for manufacturing diesel engine fuel injection pipe and common rail having high strength and excellent impact resistance and internal pressure fatigue resistance, specifically to a high-strength steel machined product made of an ultra-high low-alloy TRIP steel (TBF steel) having high hardenability mainly composed of lathy bainitic ferrite, retained austenite, and martensite, exhibiting high yield strength and tensile strength, a high-strength forged product, a high-pressure fuel injection pipe, and a common rail for accumulator fuel injection system mounted on a diesel engine, and to a method for manufacturing thereof.

2. Description of the Related Art

It should be noted that typical examples of the high-strength forged product according to the present invention include near-net shape forged products, encompassing not only primary forged products but also secondary forged products obtained by further forging (such as cold forging and warm forging) the primary forged products, precision forged products such as tertiary forged products, ultimate products obtained by machining these forged products into complex shapes, and a common rail for accumulator fuel injection system mounted on a diesel engine.

Forged products in the industrial fields of automobile, electric equipment, machines, and the like are normally manufactured by performing various forging (machining) methods at different heating temperatures, followed by performing thermal refining (heat treatment) such as hardening and tempering. For example, in an automobile, crank shaft, connecting rod, transmission gear, common rail for accumulator fuel injection system mounted on a diesel engine, and the like normally adopt hot-forged products (pressurizing temperature in a range of 1100° C. to 1300° C.) and warm-forged products (pressurizing temperature in a range of 600° C. to 800° C.), and pinion gear, gear, steering shaft, valve lifter, and the like normally adopt cold-forged products (pressurized at normal temperature).

In recent years, to attain weight reduction of an automobile body and to assure collision safety of automobiles, there have been examined the use of formable ultra-high strength low-alloy TRIP steels (TBF steels) having the transformation-induced plasticity of retained austenite.

For example, Japanese Patent Laid-Open No. 2004-292876 discloses a technology relating to the method for manufacturing high-strength forged product having high elongation and excellent balance of strength and drawing characteristics in a high-strength region giving 600 MPa or larger tensile strength through an exclusive heat treatment of performing austempering at a specified temperature after having performed both annealing and forging generally at a temperature of two-phase region of ferrite and austenite; and Japanese Patent Laid-Open No. 2005-120397 discloses a technology of manufacturing high-strength forged product having high elongation and excellent balance of strength and drawing characteristics by performing both annealing and forging mostly at a temperature of two-phase region of ferrite and austenite and then performing austempering at a specified temperature, after having separately formed tempered bainite or martensite; and Japanese Patent Laid-Open No. 2004-285430 discloses a technology of manufacturing high-strength forged product having excellent stretch flangeability and workability along with allowing the decrease in the temperature at the time of forge processing, by performing forge processing in the two-phase range and then performing specified austempering, after having heated the article to a temperature of two-phase range.

When, however, the forged products obtained by the above disclosed methods are manufactured, problems described below may be raised.

Since a forged product generates heat depending on the processing ratio of the article, the temperature may differ at positions therein during forging. For example, forging at a high temperature (near Ac3 point) increases the generated heat with increase in the processing ratio, and there occurs coalescence and growth of austenite grains, which may induce coarse retained austenite after the heat treatment. Therefore, it can be considered that the impact resistance is deteriorated (problem at the time of high-temperature forging). On the other hand, when forging is performed at a low temperature (near Ac1 point), low processing ratio makes it impossible to secure sufficient generation of heat, which may result in forming a large amount of unstable retained austenite. Thus, it can be considered that the impact resistance is deteriorated because hard martensite is generated as an origin of the fracture after the heat treatment (problem at the time of low-temperature forging). Consequently, when the temperature and processing ratio differ in a forged product, there likely appear coarse retained austenite and unstable austenite in a part, which results in having difficulty in obtaining stable and excellent impact resistance for the entire forged product.

Japanese Patent Laid-Open No. 2007-231353 discloses a technology of manufacturing a steel-made high-strength machined product having excellent impact resistance with high elongation and excellent balance of strength and drawing characteristics giving 600 MPa or larger tensile strength irrespective of the forging temperature and the forging processing ratio, and a high-pressure fuel pipe (specifically diesel engine fuel injection pipe, diesel engine common rail, and the like having high strength and excellent impact resistance) through the addition of one or more of Nb, Ti, and V and an adequate amount of Al at the time of forming a hot-rolled steel, and performing heat treatment of both annealing and forging mostly at a temperature of two-phase range of ferrite and austenite, followed by performing austempering treatment at a specified temperature.

The invention disclosed in Japanese Patent Laid-Open No. 2007-231353 is superior to the technologies disclosed in Japanese Patent Laid-Open No. 2004-292876, Japanese Patent Laid-Open No. 2005-120397 and Japanese Patent Laid-Open No. 2004-285430 at the viewpoint of providing a special effect which cannot be obtained by these technologies, and thus the ultra-high strength low-alloy TRIP steel (TBF steel) manufactured by the invention is expected to significantly contribute to the weight-reduction of automobile bodies and the collision safety of automobiles. Since, however, the ultra-high strength low-alloy TRIP steel (TBF steel) allows the fine grain bainite-ferrite and square-shape ferrite to coexist with the lathy structure of bainite-ferrite in the matrix, there is needed a high hardenability in order to obtain perfect TBF steel for attaining further high yield strength and tensile strength. At present, however, the ultra-high low-alloy TRIP steel (TBF steel) having that high hardenability has not been developed yet.

SUMMARY OF THE INVENTION

The present invention has been made responding to the above current situations, and an object of the present invention is to provide a high-strength steel machined product having excellent hardenability, a diesel engine fuel injection pipe, and a common rail thereof having high strength and excellent impact resistance and internal pressure fatigue resistance, which have a metal microstructure giving excellent balance of strength and toughness and high stability of retained austenite through the control of quantities of additives in the chemical composition, irrespective of the forging temperature and the forging processing ratio.

The inventors of the present invention aimed at manufacturing a high-strength steel machined product having excellent hardenability and having a metal microstructure giving excellent balance of strength and toughness and high stability of retained austenite, irrespective of the forging temperature and the forging processing ratio, and at manufacturing a diesel engine fuel injection pipe and a common rail thereof having high strength and excellent internal pressure fatigue resistance, and aimed at establishing a method for manufacturing thereof. With the above aims, the inventors of the present invention conducted specific experimental studies using an ultra-high strength low-alloy TRIP steel (TBF steel) having a matrix structure of bainite-ferrite and/or martensite, focusing on the effect of the hot-forging and the subsequent isothermal transformation holding process (FIT process) on the microstructure and the mechanical characteristics of the TBF steel.

As a result, The inventors of the present invention have found that the addition of an adequate amount of two or more of Cr, Mo, and Ni for improving the hardenability, an adequate amount of one or more of Nb, Ti, and V for improving the strength (fatigue strength) by refining the crystal grains, and an adequate setting of the carbon equivalent (Ceq), allows providing a high-hardenability ultra-high strength low-alloy TRIP steel (TBF steel) having excellent balance of strength and toughness and high yield strength and tensile strength, the TRIP steel having a metal microstructure in which the mother-phase structure is made mainly of lathy bainitic ferrite, a small amount of granular bainitic austenite and polygonal ferrite is contained, and the secondary-phase structure is made of fine retained austenite and martensite.

That is, the high-strength steel machined product having excellent hardenability according to the present invention comprises: 0.1 to 0.7% of C; 2.5% or less (excluding 0%) of Si; 0.5 to 3% of Mn; 1.5% or less of Al; 0.01 to 0.3% as the sum of one or more of Nb, Ti, and V; 2.0% or less (excluding 0%) of Cr; 0.5% or less (excluding 0%) of Mo; 2.0% or less of Ni; 0.7 to 3.0% as the sum of two or more of Cr, Mo, and Ni; 0.75 to 0.90% of carbon equivalent (Ceq) defined by the following formula 1; and the balance of Fe and inevitable impurities, wherein the metal structure is composed of a mother-phase structure containing 50% or more (volume percentage to the entire structure, same is applied to the following structures) of lathy bainitic ferrite and 20% or less as the sum of polygonal ferrite and granular bainitic ferrite, and a secondary-phase structure has 5 to 30% of retained austenite and 5% or less of martensite.

$$Ceq=C+Mn/6+Si/24+Ni/40+Cr/5+Mo/4+V/14 \quad \text{[Formula 1]}$$

The high-strength steel machined product having excellent hardenability may further contain 0.005% or less (excluding 0%) of B.

Above-described high-strength steel machined product having excellent hardenability includes forged products. Above-described machined product includes a high-pressure fuel pipe. The above-described high-pressure fuel pipe includes a diesel engine fuel injection pipe having high strength and excellent impact resistance and internal pressure fatigue resistance, or a diesel engine common rail having high strength and excellent impact resistance and internal pressure fatigue resistance.

The method for manufacturing the high-strength steel machined product according to the present invention comprises the steps of: using a steel material having a composition satisfying the above composition; holding the steel material in a temperature range of Ac3 point or above for a specified period, preferably for 1 second or more; subjecting the steel material to plastic working at the temperature range; cooling the steel material to a temperature range of 300° C. to 450° C. (preferably 325° C. to 425° C.), at a specified average cooling rate, preferably 1° C./s or more; and holding the steel material at the temperature range for 100 to 2000 seconds, (preferably 1000 seconds).

The method for manufacturing the diesel engine fuel injection pipe according to the present invention comprises the steps of: using a steel material having a composition satisfying the above composition; heating and holding the steel material at temperatures of 1200° C. or above; applying hot-extrusion to the steel material; holding the extruded steel bar in a temperature range of Ac3 point or above for a specified period, preferably for 1 second or more; applying warm-extrusion to the steel bar in the temperature range; cooling the steel bar to a temperature range of 300° C. to 450° C., (preferably from 325° C. to 425° C.), at a specified average cooling rate, preferably 1° C./s or more; holding the steel bar at the temperature range for 100 to 2000 seconds, (preferably 1000 seconds); cooling the steel bar to room temperature; then performing sequentially drilling in the axial direction of formed pipe by gun-drill machining, pipe-stretching for rolling in the radial direction and/or in the pipe-axis direction, cutting, pipe-end machining, and bending on the pipe.

The method for manufacturing the diesel engine common rail according to the present invention comprises the steps of: using a steel material having a composition satisfying the above composition; heating and holding the steel material at temperatures of 1200° C. or above; applying hot-extrusion to the steel material; holding the extruded steel bar in a temperature range of Ac3 point or above for a specified period, preferably 1 second or more; applying warm-extrusion to the steel bar in the temperature range; cooling the steel bar to a temperature range of 300° C. to 450° C., (preferably from 325° C. to 425° C.), at a specified average cooling rate, preferably 1° C./s or more; holding the steel bar at the temperature range for 100 to 2000 seconds, (preferably 1000 seconds); cooling the steel bar to room temperature; then performing sequentially drilling in the axial direction of formed pipe by gun-drill machining, pipe-stretching for rolling in the radial direction and/or in the pipe-axis direction, cutting the pipe, machining the pipe, and assembling the pipes.

According to the present invention, use of a steel having an adequate selection of the composition, adding an adequate quantity of two or more of Cr, Mo, and Ni to improve the hardenability, an adequate quantity of one or more of Nb, Ti, and V to improve the strength (fatigue strength) by refining the crystal grains, and an adequate selection of the carbon equivalent (Ceq), and applying a specified heat treatment to the steel material, provides a high-hardenability ultra-high strength low-alloy TRIP steel (TBF steel) having excellent balance of strength and toughness, which TRIP steel has a metal microstructure with the mother-phase structure made mainly of lathy bainitic ferrite containing a small amount of granular bainitic austenite and polygonal ferrite, and the secondary-phase structure made of fine retained austenite and martensite. As a result, there can be provided a high-strength steel machined product having excellent hardenability, and a diesel engine fuel injection pipe and a common rail thereof having high strength and excellent impact resistance and internal pressure fatigue resistance, irrespective of the heating temperature and the processing ratio (forging processing ratio and rolling processing ratio).

BRIEF DESCRIPTION OF THE DRAWINGS

The file of this patent contains at least one drawing executed in color. Copies of this patent with color drawings will be provided by the Patent and Trademark Office upon request and payment of the necessary fee.

DETAILED DESCRIPTION OF THE PREFERRED EMBODIMENTS

Figure 1:
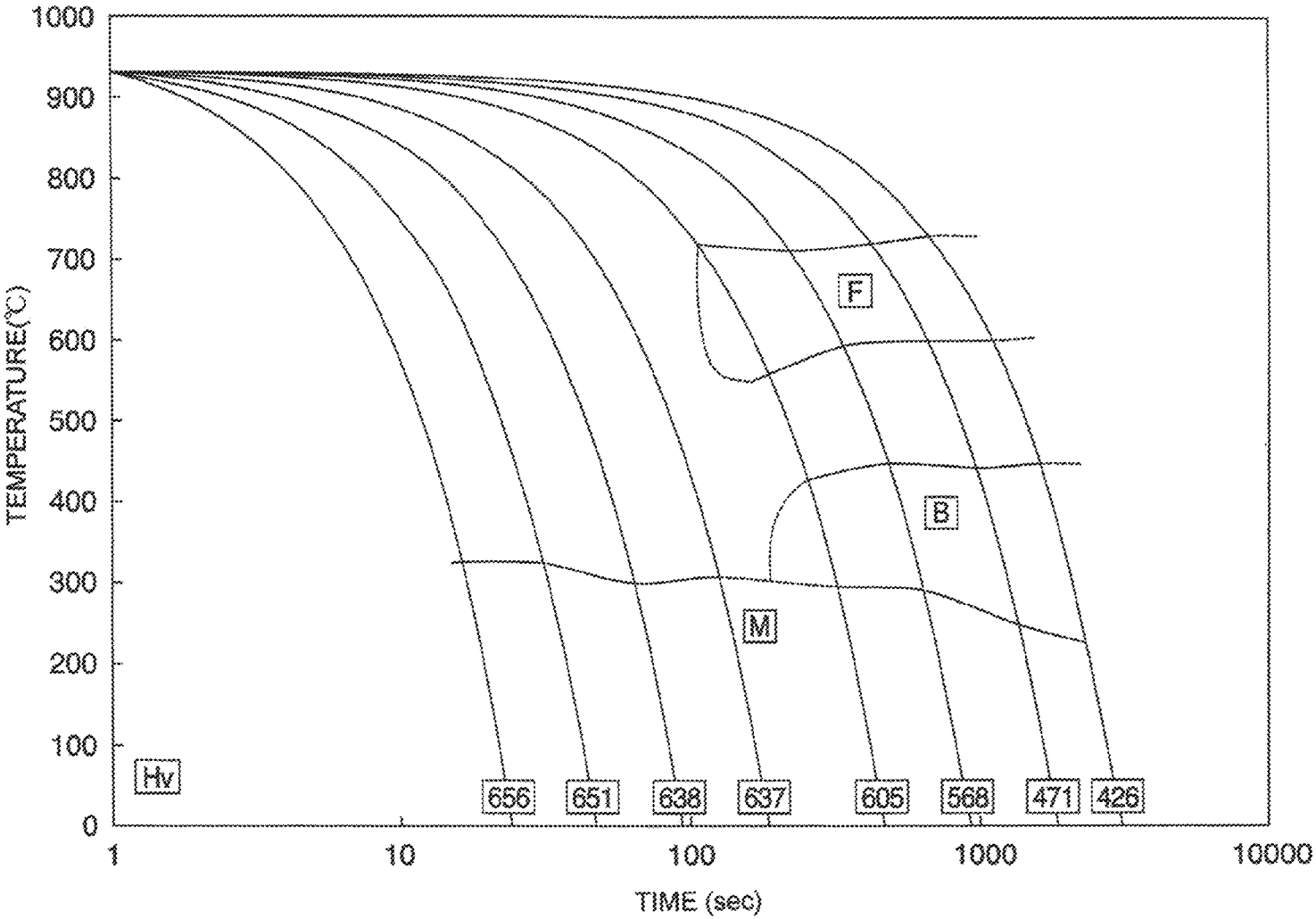
FIG. 1 is a graph showing CCT curves of Steel grade No. 1 specimen in Example 1 of the present invention.

The reason of specifying the respective contents of Cr, Mo, and Ni to improve the hardenability in the present invention is the following.

Chromium, Mo, and Ni are effective elements for strengthening of steel, and are not only effective for stabilizing the retained austenite and for securing desired amount of the retained austenite but also effective for improving the hardenability of steel. To fully performing the improving effect of hardenability, however, it is necessary to add two or more of Cr by 2.0% or less (excluding 0%), Mo by 0.5% or less (excluding 0%), and Ni by 2.0% or less (excluding 0%) as the sum of them by 0.7 to 3.0%. The reason of the necessity is that, if the sum of the two or more of Cr, Mo, and Ni is less than 0.7%, the effect of improving the hardenability cannot fully be attained, and if the sum thereof exceeds 3.0%, the bainite transformation temperature decreases to result in difficult to deposit the bainitic ferrite, which then forms martensite phase to bring the steel hard and brittle, thus resulting in excessively high hardenability.

According to the present invention, the steel material further contains one or more of Nb, Ti, and V by a quantity of sum of them from 0.01 to 0.3% to attain further refined crystal grains. The addition of one or more of Nb, Ti, and V by the above quantity is to readily obtain the metal structure described below and further attain desired characteristics by performing heat treatment of: annealing at a temperature of austenite single phase region and at a temperature of mostly two-phase region of ferrite and austenite; further performing plastic working such as forging; followed by performing austempering at a specified temperature.

Mother-Phase Structure: 50% or More of Lathy Bainitic Ferrite and 20% or Less as the Sum of Polygonal Ferrite and Granular Bainitic Ferrite For a high-strength steel machined product having excellent hardenability to improve the strength, the impact resistance, the internal pressure fatigue resistance, and the balance of strength and toughness, there is needed to assure 50% or more of the volume percentage of lathy bainitic ferrite. The volume percentage of sum of the polygonal ferrite and the granular bainitic ferrite is limited to 20% or less as the sum of them because higher than 20% thereof deteriorates the toughness.

Secondary-Phase Structure: 5 to 30% of Retained Austenite and 5% or Less of Martensite The machined product of the present invention has the metal structure containing lathy bainitic ferrite, polygonal ferrite, and granular bainitic ferrite as the mother-phase structure, and further containing retained austenite and martensite as the secondary-phase structure. Among these, although the retained austenite is effective for improving the total elongation, and is effective for improving the impact resistance owing to the resistance to crack induced by the plasticity-induced martensite transformation, less than 5% of the volume percentage of the retained austenite cannot fully attain the above effect, and more than 30% thereof decreases the C concentration in the retained austenite to result in forming an unstable retained austenite to fail in fully attaining the above effect. Consequently, the volume percentage of the retained austenite is specified to a range of 5 to 30%. Since the martensite becomes an origin of fracture at the interface with the mother-phase, the volume percentage of the martensite to the entire structure is specified to 5% or less, (preferably from 1 to 3%).

In the present invention, components other than above are required to be controlled as below to surely forming the above metal structure and to efficiently increase the mechanical characteristics such as tensile strength and toughness.

C: 0.1 to 0.7%

Carbon is an essential element to assure high strength and to secure retained austenite. Specifically, C is effective to secure C in the austenite and to keep stable retained austenite even at room temperature, thus increasing the ductility and the impact resistance. Less than 1% of C content cannot fully attain the effect. When C is added excessively, above 0.7%, there increases the amount of retained austenite and likely enriches C in the retained austenite to attain high ductility and high impact resistance. However, when the C addition exceeds 0.7%, the effect saturates, and defects caused by center-segregation and other drawbacks appear to deteriorate the impact resistance. Therefore, the upper limit of C content is specified to 0.7%.

Si: 2.5% or Less (Excluding 0%)

Since Si is an oxide-forming element, excess amount of Si deteriorates the impact resistance. Thus the adding quantity of Si is specified to 2.5% or less. The steel product according to the present invention requires the addition of Al which performs similar function as that of Si. However, from the point of solid-solution strengthening by Si addition and of increase in the amount of formed retained austenite, Si can be added by a quantity of 0.5% or more.

Mn: 0.5 to 3%

Manganese is an element necessary to stabilize the austenite and to obtain a desired amount of retained austenite. In order to effectively fulfill the above functions, the addition of Mn by a quantity of 0.5% or more (preferably 0.7% or more, and more preferably 1% or more) is required. Since, however, excess addition of Mn induces negative effects such as crack generation on a strand cast, the Mn content is specified to 3% or less, preferably 2.5% or less, and more preferably 2% or less.

Al: 1.5% or Less

Similar to Si, Al is an element of suppressing the deposition of carbide. Since, however, Al has stronger ferrite-stabilizing performance than Si, the Al addition brings the timing of beginning of transformation earlier than the case of Si addition, thus C is likely enriched in the austenite even during a short-period of holding (such as forging). As a result, Al addition can further stabilize the austenite, which results in shifting the C-concentration distribution in the generated austenite into high-concentration region, and further increases the amount of generated retained austenite, thus providing high impact resistance. Addition of Al above 1.5%, however, raises the Ac3 transformation point of steel, which is not preferable in industrial operations. Consequently, the upper limit of Al addition is specified to 1.5%, and preferably 0.05%.

B: 0.005% or Less

Similar to Cr and Mo, B is an element effective for improving the hardenability of steel. The content of B is preferably 0.005% or less to increase the hardenability without decreasing the delayed fracture strength and to keep the cost at a low level.

The present invention further restricts the carbon equivalent defined by the formula described above to a range of 0.75% to 0.90%. The range is important to secure the above-specified metal structure and to further improve the balance of strength and toughness. That is, if the carbon equivalent (Ceq) is less than 0.75%, the refining of crystal grains cannot fully be attained, and the lathy bainitic ferrite as the mother-phase structure is difficult to be secured to 50% or more. If the carbon equivalent exceeds 0.90%, the hardenability becomes excessive to increase excessively both the yield stress and the tensile strength, which fails in attaining the effect of improving the toughness.

The method for manufacturing the high-strength steel machined product according to the present invention comprises the steps of: using a steel material satisfying the composition specified before; holding the steel material in a temperature range of Ac3 point or above for a specified period, preferably for 1 second or more; subjecting the steel material to plastic working at the temperature range; cooling the steel material to a temperature range of 300° C. to 450° C., (preferably from 325° C. to 425° C.), at a specified average cooling rate, preferably 1° C./s or more; and holding the steel material at the temperature range for 100 to 2000 seconds, (preferably 1000 seconds). The reason of specifying the heat-treatment condition is described below.

The reason that the steel material is held in a temperature range of Ac3 point or above for 1 second or more is that the heating temperature is brought to a temperature range of mostly the two-phase region to the austenite single phase range in order to obtain the fine lathy bainitic ferrite and the secondary-phase structure. If the heating temperature is below the Ac3 point, fine lathy bainitic ferrite and the secondary-phase structure cannot fully be deposited. Regarding the holing time at above-given temperature range, when the heating means adopts high-frequency wave heating, for example, holding of the steel material in the temperature range of Ac3 point of above can instantaneously be attained. Accordingly, the preferable holding time is specified to 1 second or more. Although the upper limit of the holding time is not specifically limited, about 30 minutes are the upper limit in view of productivity.

The above-described plastic working includes forging, extruding, boring, and tube-reducing by rolling. The condition of these plastic workings is not specifically limited, and a commonly adopted method can be applied.

After the above plastic working, the present invention applies the steps of cooling the steel material to a temperature range of 300° C. to 450° C., (preferably 325° C. to 425° C.), at a specified average cooling rate, preferably 1° C./s or more, then holding the steel material at the temperature range for 100 to 2000 seconds, (austempering). The preferable average cooling rate is specified to 1° C./s or more to suppress the formation of pearlite. The temperature of austempering is specified to a range of 300° C. to 450° C., (preferably from 325° C. to 425° C.), because below 300° C. of austempering gives slow diffusion of carbon and fails to obtain a specified amount of retained austenite, and because above 450° C. thereof deposits cementite to hinder the carbon enrichment in the austenite, thus failing in obtaining a specified amount of retained austenite. Furthermore, the period of time for austempering is specified to a range of 100 to 2000 seconds because less than 100 seconds of austempering causes insufficient enrichment of carbon and fails to form a specified amount of retained austenite, thus resulting in transforming the unstable retained austenite to martensite, and because more than 2000 seconds thereof induces decomposition of once-formed retained austenite. More preferably the period of time for austempering is in a range of 100 to 1000 seconds.

The present invention also specifies the method for manufacturing diesel engine fuel injection pipe and diesel engine common rail under the above-described manufacturing conditions.

An applicable method for manufacturing the diesel engine fuel injection pipe is the one comprising the steps of: using a steel material satisfying the above-specified composition; heating and holding the steel material at temperatures of 1200° C. or above; applying hot-extrusion to the steel material; holding the extruded steel bar in a temperature range of Ac3 point or above for a specified period, preferably for 1 second or more; applying warm-extrusion to the steel bar in the temperature range; cooling the steel bar to a temperature range of 300° C. to 450° C. (preferably 325° C. to 425° C.), at a specified average cooling rate, preferably 1° C./s or more; holding the steel bar at the temperature range for 100 to 2000 seconds; cooling the steel bar to room temperature; then performing sequentially drilling in the axial direction of formed pipe by gun-drill machining, pipe-stretching for rolling in the radial direction and/or in the pipe-axis direction, cutting, pipe-end machining, and bending on the pipe.

An applicable method for manufacturing the diesel engine common rail adopts almost the same conditions as those of the method for manufacturing the diesel engine fuel injection pipe given above. The method comprises the steps of: using a steel material satisfying the specified composition; heating and holding the steel material at temperatures of 1200° C. or above; applying hot-extrusion to the steel material; holding the extruded steel bar in a temperature range of Ac3 point or above for a specified period, preferably 1 second or more; applying warm-extrusion to the steel bar in the temperature range; cooling the steel bar to a temperature range of 300° C. to 450° C. (preferably 325° C. to 425° C.), at a specified average cooling rate, preferably 1° C./s or more; holding the steel bar at the temperature range for 100 to 2000 seconds; cooling the steel bar to room temperature; then performing sequentially drilling in the axial direction of formed pipe by gun-drill machining, pipe-stretching for rolling in the radial direction and/or in the pipe-axis direction, cutting the pipe, machining the pipe, and assembling the pipes.

In the above-described method for manufacturing the diesel engine fuel injection pipe and for manufacturing the diesel engine common rail, there is a case of performing the step of cooling the steel material to a temperature range of Ac3 point or above after the step of hot-extruding. The method of cooling, however, is not specifically limited. After the step of holding the steel material at a specified temperature for 100 to 2000 seconds, the step of cooling the steel material to room temperature is preferably executed quickly. In the method for manufacturing the diesel engine common rail, the step of gun-drill machining for drilling the steel bar in the axial direction thereof is given after the step of hot-extruding. The cooling method is not specifically limited.

The steel material used for the above-Manufacturing methods includes billet and hot-rolled round bar, and they may be prepared by forming an ingot satisfying the target composition using a known method, and by forming the ingot into a slab, followed by directly hot-working or hot-working after cooling to room temperature and after re-heating.

EXAMPLES

The present invention is described in more detail below referring to the examples. The present invention is, however, not limited to these examples, and various changes and modifications without departing from the spirit of the present invention are within the technical scope of the present invention.

Example 1

The testing steel slabs of Steel grades Nos. 1 to 6 having the respective compositions given in Table 1 (the unit in Table 1 is % by mass, and the balance is Fe and inevitable impurities), were formed by continuous casting. They were reheated to a 1250° C. region, hot-rolled, pickled, and then machined to form the respective specimens for forging in the shape of square bar of 20 mm in thickness, 80 mm in length, and 32 mm in width through the use of steel bar of 32 mm in diameter and 80 mm in length.

Then, for each testing steel grade, each specimen for forging was heated to the respective forging temperatures given in Table 2 for 1 second or longer period to thereby perform forging processing by using a mold which was heated to the same temperature as the heating temperature of the specimen, and thus 10 to 70% of compression forging strain was provided. After that, the specimen was cooled to the austempering temperature given in Table 2 at an average cooling rate of 1° C./s to conduct austempering treatment for holding the isothermal transformation state for the period given in Table 2.

Figure 2:
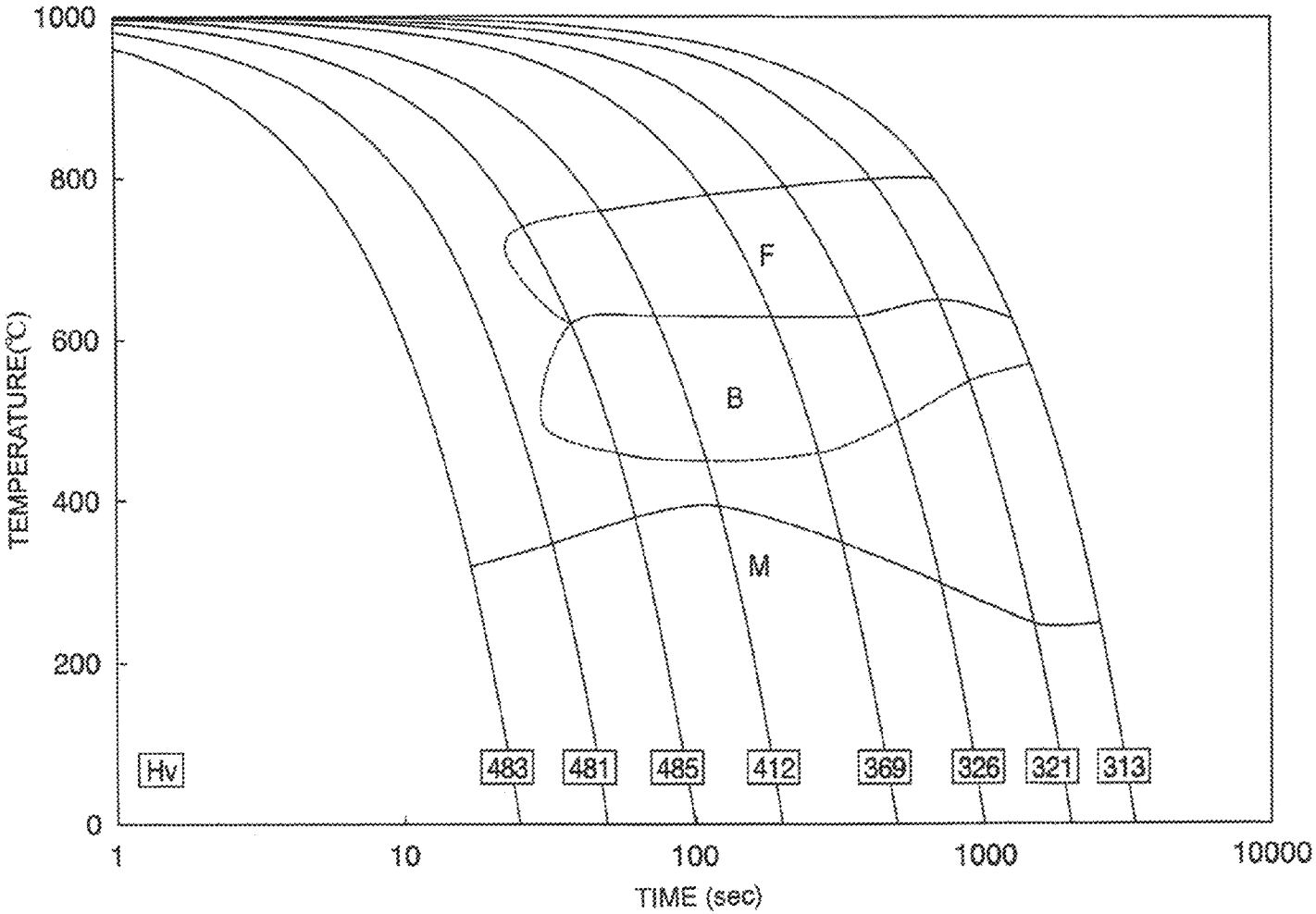
FIG. 2 is a graph showing CCT curves of Steel grade No. 5 specimen in Comparative Examples in Example 1 of the present invention.
Figure 3:
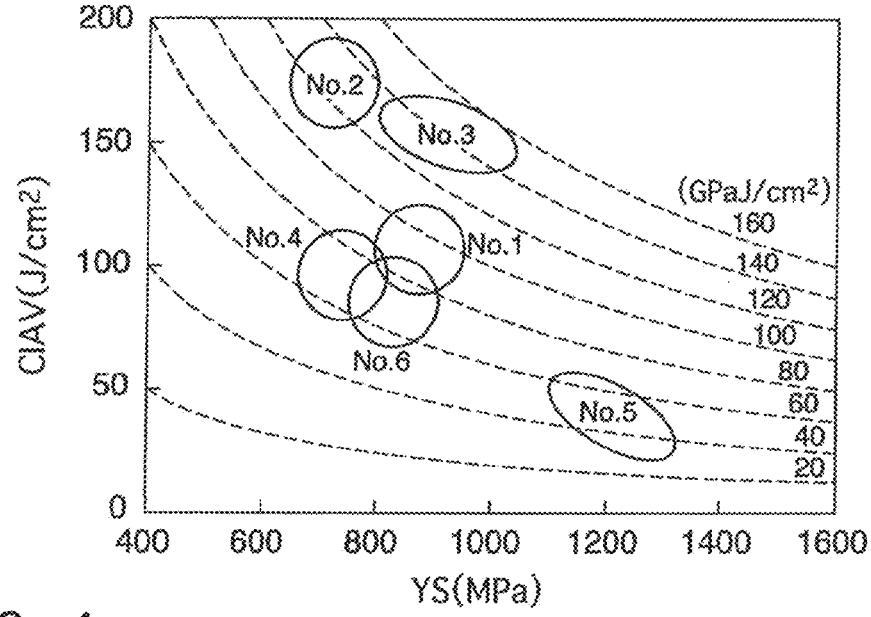
FIG. 3 is a graph showing a comparison of the relation between yield strength (YS) and Charpy impact absorption value (CIAV) of Steel grades Nos. 1, 2, and 3 specimens of Example 1 and Steel grades Nos. 4, 5, and 6 specimens of Comparative Examples of the present invention.
Figure 4:
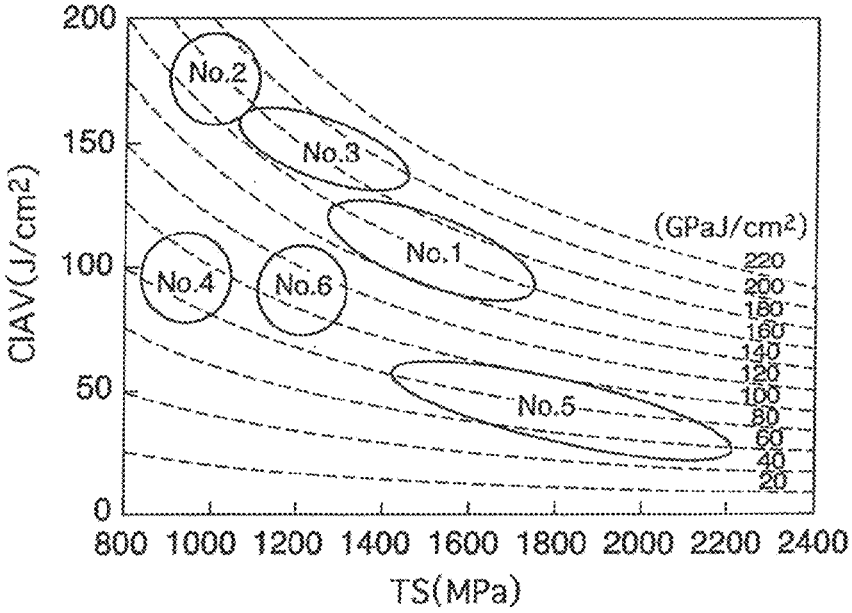
FIG. 4 is a graph showing a comparison of the relation between tensile strength (TS) and Charpy impact absorption value (CIAV) of Steel grades No. 1, 2, and 3 specimens of Example 1 and Steel grades Nos. 4, 5, and 6 specimens of Comparative Examples of the present invention.
Figure 5:
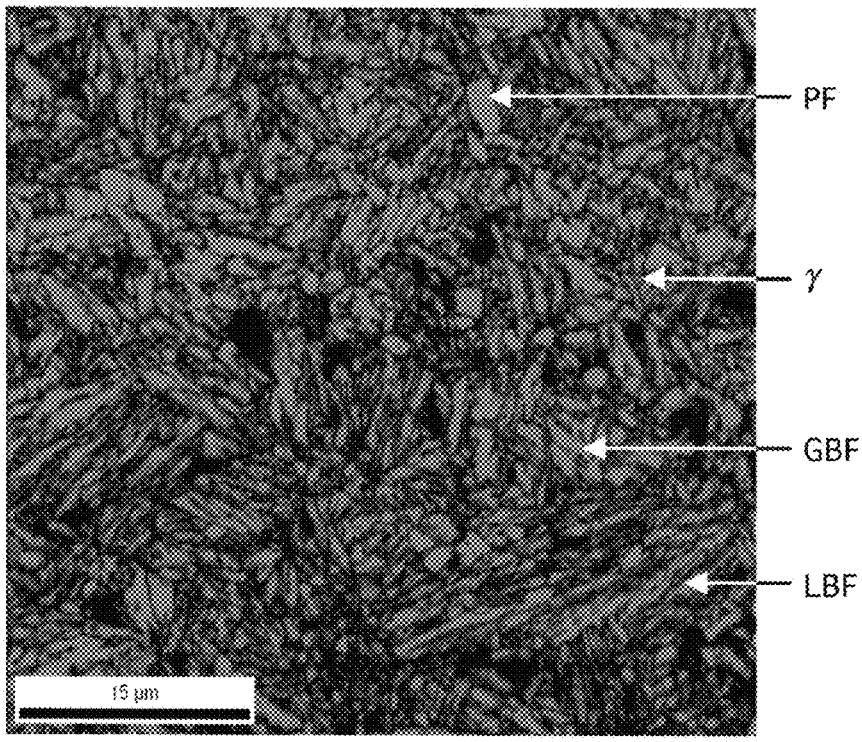
FIG. 5 is a photograph illustrating the metal structure (microscope photograph) of Steel grade No. 1 specimen in Example 1 of the present invention, after hot-forging.

With respect to thus obtained forged materials, there were determined tensile strength (TS), yield strength (YS), elongation index (EI), Charpy impact value (CIV), and volume percentage (space factor) of each structure under the respective conditions given below. Furthermore, among the specimens in Example 1, the CCT curves of the Steel grade No. 1 and the Steel grade No. 5 as the representatives of these specimens are given in FIG. 1 and FIG. 2, respectively, (F is ferrite, B is bainite, and M is martensite); and the balance of strength and toughness of the respective specimens is given in FIG. 3 (yield strength) and FIG. 4 (tensile strength). Moreover, among the Steel grades Nos. 1 to 3 of Example 1, the metal structure (microscope photograph) of the Steel grade No. 1 after the hot-forging heat treatment, as a typical example, is given in FIG. 5, (the green phase is the matrix composed mainly of lathy bainitic ferrite (LBF), and the red phase is the retained austenite (γ)).

Determination of Yield Strength, Tensile Strength, and Elongation

The yield strength (TS), the tensile strength (TS), and the elongation index (EI) were determined by using JIS 14B specimens (20 mm in length at parallel section, 6 mm in width, and 1.2 mm in thickness) cut from the above respective forged materials. The testing condition was 25° C. and 1 mm/min of cross-head speed.

Charpy Impact Test (Toughness)

The Charpy impact absorption value (CIAV) was determined by using a JIS 5B specimen (2.5 mm in width) cut from the above forged material. The test condition was 25° C. and 5 m/s.

Observation of Structure

Regarding the volume percentage (space factor) of the structure in each forged material, the structure was determined by the observation of the forged materials corroded by Nital and LePera, respectively, under an optical microscope (magnification of ×400 or ×1000) and a scanning electron microscope (SEM: magnification of ×1000 or ×4000), by the measurement of amount of retained austenite using the saturated magnification method (Heat Treatment, Vol. 1, 136, p. 322, (1996)), by the determination of C concentration in austenite using X-ray, and by the structural analysis using a transmission electron microscope (TEM: magnification of × 10000) and FE/SEM-EBSP with a step-interval of 100 nm. For each of thus obtained various grades of forged steel materials, the determined volume percentage of structure and dynamic characteristics are given also in Table 2.

Retained Austenite Characteristics (γR)

For each forged material, the initial volume percentage of retained austenite (fγo) and the initial carbon concentration in retained austenite (Cγo) were determined by the following X-ray diffractometry.

<Initial Volume Percentage of Retained Austenite (fγo)>

5-Peak method: (200)γ, (220) γ, (311) γ, (200) α, and (211) α

<Initial Carbon Concentration in Retained Austenite (Cγo)>

Determination of the lattice constant of γ, based on the peak of diffraction face of (200) γ, (220)γ, and (311)γ, respectively.

$$C\gamma=(a\gamma-3.578-0.000Si\gamma-0.00095Mn\gamma-0.0006Cr-0.0056Al\gamma-0.005Nb\gamma-0.0220N\gamma)/0.033$$

The above result derives the following consideration.

The Steel grades Nos. 1 to 3 are examples of manufacturing the forged product parts having the respectively specified structures and being formed from the respective steel grades satisfying the scope of the present invention by the respective manufacturing methods specified by the present invention. Regarding the Steel grades Nos. 1 to 3 which are the steels of the present invention, for example the Steel grade No. 1 given in FIG. 5 as the metal structure (microscope photograph), the entire mother-phase structure is mainly composed of lathy bainitic ferrite (LBF) with a small amount of granular bainitic ferrite (GBF) and polygonal ferrite (PF), and the secondary-phase structure is composed of fine retained austenite (γ) and martensite, with high stability of retained austenite, and the structure is significantly refined by the hot-forging. The forged product parts of the steels of the present invention given by the Steel grades Nos. 1 to 3 have very good balance of strength and toughness, give excellent yield stress, tensile strength, elongation index, and impact resistance, (refer to FIG. 3 and FIG. 4). The excellent toughness of these steels of the present invention presumably owes specifically to the improvement in the hardenability by the addition of Cr, Mo, and Ni, the large amount and stable retained austenite characteristics, and the refinement of structure by forging, (a mixed phase structure of lathy bainitic ferrite, fine granular retained austenite, and film-shape retained austenite). Furthermore, among the Steel grades Nos. 1 to 3, the CCT curve of the Steel grade No. 1 as a typical example shows that the martensite of the steel of the present invention given by the Steel grade No. 1 has the martensite-initiating temperature of about 320° C., and the bainite-transformation-initiation nose shifts into the long-period region. Although the CCT curves of the Steel grades Nos. 2 and 3 are not given here, the martensite-initiation temperature of these Steel grades Nos. 2 and 3 is about 420° C. for both of them, and it was revealed that the bainite-transformation-initiation nose shifts into the long-period region similar to the case of the Steel grade No. 1.

To the contrary, the following-given Comparative Examples show the following-described drawbacks; the Comparative Examples do not satisfy the required conditions specified by the present invention, specifically the condition of the content of Cr, Mo, and Ni, the condition of the metal structure to increase the quenchability, and the condition of the carbon equivalent which is important to further increase the balance of strength and toughness.

The Steel grade No. 4 is the basic steel (0.4% of C, 1.5% of Si, 1.5% of Mn, 0.5% of Al, and 0.05% of Nb) in which the proeutectoid ferrite deposited, the bainite transformation was not sufficient, and the content of Cr was small so that the hardenability deteriorated.

The Steel grade No. 5 is a Cr—Mo steel which mostly satisfies the composition specified by the present invention with the Cr content higher by only 0.5% than that of the Steel grade No. 1 of the present invention. Since, however, the carbon equivalent exceeded the upper limit of the present invention, as clearly shown by the CCT curve of the Steel grade No. 5 in FIG. 2, the initiation time of ferrite and bainite transformation in the CCT curves shifts to a significantly long time, which resulted in excessively high hardenability to excessively increase the yield stress and the tensile strength, and the effect of improving the toughness was not able to be attained.

The Steel grade No. 6 is an example using a Cr steel that almost satisfies the composition specified by the present invention. However, the amount of Mo is smaller than that of the steel of the present invention, and thus the hardenability was decreased.

TABLE 1

| Steel grade No. | | Chemical composition (% by mass) | | | | | | | | | | | | | | | | |
|---|---|---|---|---|---|---|---|---|---|---|---|---|---|---|---|---|---|---|
| | | C | Si | Mn | P | S | Cu | Ni | Cr | Mo | Al | Nb | Ti | V | B | O | N | Carbon equivalent (Ceq) |
| Example | 1 | 0.42 | 1.47 | 1.51 | <0.005 | <0.0019 | <0.02 | <0.02 | 0.50 | 0.20 | 0.48 | 0.052 | — | — | — | 0.0007 | 0.0010 | 0.883 |
| | 2 | 0.2 | 1.5 | 1.5 | <0.005 | <0.005 | <0.02 | <0.02 | 1.0 | 0.20 | 0.04 | 0.050 | — | 0.02 | 0.002 | 0.0005 | 0.0010 | 0.763 |
| | 3 | 0.2 | 1.5 | 1.5 | <0.005 | <0.005 | <0.02 | 1.5 | 1.0 | 0.20 | 0.03 | 0.050 | — | — | — | 0.0005 | 0.0010 | 0.800 |
| Compar- | 4 | 0.40 | 1.49 | 1.49 | <0.005 | <0.0021 | <0.02 | <0.02 | <0.02 | <0.01 | 0.49 | 0.048 | — | — | — | 0.0006 | 0.0009 | 0.717 |
| ative | 5 | 0.41 | 1.45 | 1.47 | <0.005 | <0.0005 | <0.02 | 0.02 | 0.99 | 0.20 | 0.48 | 0.050 | — | — | — | 0.0008 | 0.0020 | 0.964 |
| Example | 6 | 0.43 | 1.50 | 1.52 | <0.005 | 0.0023 | <0.02 | <0.02 | 0.51 | <0.01 | 0.49 | 0.052 | — | — | — | 0.0005 | 0.0009 | 0.851 |

TABLE 2

| | | Manufacturing condition | | | | Volume percentage of structure after forging (%) | | | | | Dynamic characteristics | | | |
|---|---|---|---|---|---|---|---|---|---|---|---|---|---|---|
| | | Forging | Working | Autempering | Holding | Mother phase | | | Secondary phase | | | | | |
| Steel grade No. | | temperature (° C.) | ratio (%) | temperature (° C.) | time (sec) | LBF *1 | PF *2 | GBF *3 | Retained γ *4 | Martensite | YS (MPa) | TS (MPa) | EI (%) | CIV (J/cm$^2$) |
| Example | 1 | 900 | 50 | 375 | 1000 | 70 | 2 | 3 | 23 | 2 | 785 | 1260 | 26 | 105 |
| | 2 | 900 | 50 | 400 | 1000 | 41 | 5 | 18 | 13 | 5 | 763 | 1040 | 32 | 170 |
| | 3 | 900 | 50 | 400 | 1000 | 65 | 4 | 12 | 16 | 3 | 880 | 1230 | 23 | 146 |
| Comparative | 4 | 900 | 50 | 375 | 500 | 0 | 62 | 3 | 22 | 13 | 650 | 1020 | 25 | 88 |
| Example | 5 | 900 | 50 | 375 | 500 | 5 | 1 | 0 | 6 | 88 | 1013 | 1518 | 12 | 18 |
| | 6 | 900 | 0 | 375 | 500 | 45 | 3 | 24 | 25 | 3 | 680 | 1250 | 31 | 43 |

*1 Lathy bainitic ferrite
*2 Polygonal ferrite
*3 Granular bainitic ferrite
*4 Retained austenite Example 2

A billet of the steel of the present invention, having the composition of Steel grade No. 1 in Table 1, was heated to and held at 1200° C., which was then subjected to hot-extrusion. The extruded billet was cooled to 940° C. and was held at the temperature for 1 second or more, which was then subjected to a specified warm-extrusion to form a round bar. The round bar was cooled to 325° C. at a cooling rate of 4° C./s, which was then held at the temperature for 1800 seconds. The cooled round bar was further cooled to room temperature at a specified cooling rate. After that, the round bar was treated by gun-drill machining for drilling the steel bar in the axial direction thereof to form a base pipe of fuel injection pipe. The base pipe was treated by tube-working to obtain a steel pipe for fuel injection pipe having 8.0 mm in outer diameter, 3.0 mm in inner diameter, and 2.5 mm in thickness. The pipe was cut to a specified length, to which cut pipe a threaded component such as nut was inserted. Then a joint head was press-formed to apply edge-machining, followed by bending the pipe, thus being obtained the fuel injection pipe.

Example 3

A billet of the steel of the present invention, having the composition of Steel grade No. 2 in Table 1, was heated to and held at 1250° C., which was then subjected to hot-extrusion. The extruded billet was cooled to room temperature, which was then treated by gun-drill machining for drilling the steel bar in the axial direction thereof. The drilled pipe was held at 950° C. for 1 second or more, and then was subjected to hot-rolling. The pipe was cooled to 375° C. at a cooling rate of 2° C./s, and then was subjected to austempering to hold at the temperature for 1000 seconds. Furthermore, the pipe was treated by cold-tube-working to obtain a pipe having 8.0 mm in outer diameter, 3.0 mm in inner diameter, and 2.5 mm in thickness. The pipe was treated by being cut to a specified length, edge-machining, and bending the pipe, thus being obtained the steel pipe for fuel injection pipe.

Example 4

A steel bar made of the steel of the present invention, having the composition of Steel grade No. 3 in Table 1, was drilled in the axial direction thereof at a warm temperature by the Mannesmann method. The drilled bar was heated to 1000° C. and was held at the temperature for 1 second or more, followed by hot-extrusion. The extruded bar was cooled to 350° C. at a cooling rate of 1° C./s and was held at the temperature for 950 seconds, followed by cooling to room temperature. After that, the pipe was treated by tube-reduction to a size of 6.35 mm in outer diameter, 2.35 mm in inner diameter, and 2 mm in thickness.

The pipe was then treated by being cut to a specified length, edge-machining, and bending the pipe, thus being obtained the steel pipe for fuel injection pipe.

Example 5

A billet of the steel of the present invention, having the composition of Steel grade No. 1 in Table 1, was heated to and held at 1200° C., which was cooled to room temperature. The billet was then treated by gun-drill machining for drilling the steel bar in the axial direction thereof. The drilled pipe was heated to 930° C. and was held at the temperature for 1 second or more, and then was subjected to hot-rolling. The pipe was cooled to 325° C. at a cooling rate of 5° C./s, and then was held at the temperature for 1750 seconds, followed by cooling to room temperature. After that, the pipe was treated by tube-working to obtain a pipe having 8.0 mm in outer diameter, 3.0 mm in inner diameter, and 2.5 mm in thickness. The pipe was treated by being cut to a specified length, edge-machining, and bending the pipe, thus obtained the steel pipe for fuel injection pipe.

Example 6

A billet of the steel of the present invention, having the composition of Steel grade No. 2 in Table 1, was heated to and held at 1250° C., and was treated by hot-extrusion, followed by cooling to room temperature. The billet was then treated by gun-drill machining for drilling the steel bar in the axial direction thereof. The drilled pipe was heated to 950° C. and was held at the temperature for 1 second or more, and then was subjected to hot-rolling. The pipe was cooled to 400° C. at a cooling rate of 8° C./s, and then was held at the temperature for 210 seconds to conduct austempering. After that, the pipe was treated by cold-tube-working to obtain a pipe having 8.0 mm in outer diameter, 3.0 mm in inner diameter, and 2.5 mm in thickness. The pipe was treated by being cut to a specified length, edge-machining, and bending the pipe, thus being obtained the steel pipe for fuel injection pipe.

Example 7

A steel pipe made of the steel of the present invention, having the composition of Steel grade No. 3 in Table 1, was subjected to warm-rolling, and was heated to and held at 1250° C., and further was held at 980° C. for 1 second or more, and then was treated by hot-extrusion. The extruded pipe was cooled to 325° C. at a cooling rate of 2° C./s, which was then held at the temperature for 1700 seconds, followed by cooling to room temperature. The pipe was then treated by tube-working to obtain a pipe having 8.0 mm in outer diameter, 3.0 mm in inner diameter, and 2.5 mm in thickness. The pipe was treated by being cut to a specified length, edge-machining, and bending the pipe, thus being obtained the steel pipe for fuel injection pipe.

Example 8

A steel bar of the steel of the present invention, having the composition of Steel grade No. 1 in Table 1, was treated by gun-drill machining for drilling the steel bar in the axial direction thereof. The drilled pipe was heated to 940° C. and was held at the temperature for 1 second, and was cooled to 425° C. at a cooling rate of 10° C./s, and then was held at the temperature for 220 seconds, followed by cooling to room temperature. After that, the pipe was treated by tube-working to obtain a pipe having 8.0 mm in outer diameter, 3.0 mm in inner diameter, and 2.5 mm in thickness. The pipe was treated by being cut to a specified length, edge-machining, and bending the pipe, thus being obtained the steel pipe for fuel injection pipe.

Example 9

A billet of the steel of the present invention, having the composition of Steel grade No. 2 in Table 1, was heated to and held at 1200° C., which was then cooled to room temperature. The billet was cooled to 425° C. at a cooling rate of 3° C./s, and was held at the temperature for 220 seconds, followed by cooling to room temperature. The billet was then treated by tube-reducing to obtain a pipe having 8.0 mm in outer diameter, 3.0 mm in inner diameter, and 2.5 mm in thickness. The pipe was treated by being cut to a specified length, edge-machining, and bending the pipe, thus being obtained the steel pipe for fuel injection pipe.

Example 10

A billet of the steel of the present invention, having the composition of Steel grade No. 1 in Table 1, was treated by hot-extrusion. The billet was then treated by cold-gun-drill machining for drilling the billet in the axial direction thereof. The drilled base pipe was treated by hot-rolling at 1200° C., which was then held at 930° C. for 1 second or more, followed by cooling to 450° C. at a cooling rate of 4° C./s, and then was held at the temperature for 100 seconds to conduct austempering. After that, the pipe was treated by cold-tube-working to obtain a pipe having 30 mm in outer diameter, 8 mm in inner diameter, and 11 mm in thickness. The pipe was treated by cutting to a specified length, machining on outer peripheral face to form a conical sheet face and to drill a branch hole of 3 mm in diameter, and assembling a retainer having a threaded sleeve on the peripheral edge of the branch hole, thus being obtained the common rail.

Example 11

A billet of the steel of the present invention, having the composition of Steel grade No. 2 in Table 1, was treated by hot-extrusion. The billet was then treated by cold-gun-drill machining for drilling the billet in the axial direction thereof. The drilled pipe was treated by cold-tube-working to obtain a pipe having 30 mm in outer diameter, 8 mm in inner diameter, and 12 mm in thickness. The pipe was treated by cutting to a specified length and by machining. The pipe was then heated to 1200° C., which was then held at 950° C. for 1 second, followed by cooling to 300° C. at a cooling rate of 1° C./s, and was held at the temperature for 2000 seconds to conduct austempering. After that, assembly of the pipes was given to obtain the common rail.

Example 12

A billet of the steel of the present invention, having the composition of Steel grade No. 3 in Table 1, was heated to 1300° C., and was drilled by the Mannesmann method. The drilled base pipe was treated by hot-rolling at 1200° C., and then was treated by cold-tube-reducing. After that, the base pipe was held at 950° C. for 1 second or more, and further was cooled to 350° C. at a cooling rate of 5° C./s, which was then held at the temperature for 1200 second to conduct austempering. The base pipe was treated by cold-tube-working to obtain a pipe having 32 mm in outer diameter, 8 mm in inner diameter, and 12 mm in thickness. The pipe was treated by cutting to a specified length, machining on outer peripheral face to form a conical sheet face and to drill a branch hole of 3 mm in diameter, and assembling of a retainer having a threaded sleeve on the peripheral edge of the branch hole, thus being obtained the common rail.

Example 13

A billet of the steel of the present invention, having the composition of Steel grade No. 3 in Table 1, was treated by cold-rolling. The billet was then treated by gun-drill machining for drilling the billet in the axial direction thereof. The drilled base pipe was treated by hot-rolling at 1200° C., which was then held at 950° C. for 1 second or more, followed by cooling to 400° C. at a cooling rate of 8° C./s, and further was held at the temperature for 500 seconds to conduct austempering. After that, the pipe was treated by cold-tube-working to obtain a pipe having 32 mm in outer diameter, 8 mm in inner diameter, and 12 mm in thickness. The pipe was treated by cutting to a specified length, machining, and assembling, thus being obtained the common rail.

Example 14

A steel base material made of the steel of the present invention, having the composition of Steel grade No. 1 in Table 1, was cut to a specified length, which was then subjected to rough warm-forging, and was heated to 1200° C., then was held at the temperature for 1 second or more, and further was subjected to hot-forging into a bar shape of 32 mm in outer diameter at the body section having many boss-parts of 18 mm in diameter. The forged product was cooled to 450° C. at a cooling rate of 9° C./s, and was held at the temperature for 1200 seconds to conduct austempering. After that, the steel bar was cooled to room temperature, and was treated by the Long-drilling method to drill to open a pipe hole of 9 mm in diameter in the axial direction of the steel bar, further by machining such as formation of external threads of M16 on outer periphery of the boss part, formation of a conical sheet surface at top of the boss part, and drilling of a branch hole of 3 mm in diameter, thus being obtained the common rail.

Example 15

A steel base material made of the steel of the present invention, having the composition of Steel grade No. 2 in Table 1, was heated to 1200° C., and was subjected to forging. The steel base material was held at 950° C. for 1 second or more, and then was hot-forged to form a bar shape of 32 mm in outer diameter at the body section with many of boss parts having 18 mm in diameter. The steel bar was then cooled to 425° C. at a cooling rate of 7° C./s, followed by holding thereof at the temperature for 200 seconds to conduct austempering. After that, the steel material was cooled to room temperature, and was treated by the Long-drilling method to drill to open a pipe hole of 9 mm in diameter in the axial direction of the steel bar, and further by machining such as formation of external threads of M16 on outer periphery of the boss part, formation of a conical sheet face at top of the boss part, and drilling of a branch hole of 3 mm in diameter, thus being obtained the common rail.

Example 16

A steel base material made of the steel of the present invention, having the composition of Steel grade No. 3 in Table 1, was heated to 1200° C., and was subjected to hot-extrusion, then was cut to a specified length. The steel base material was held at 950° C. for 1 second or more, and was treated by hot-forging into a bar shape of 32 mm in diameter at body section with many boss parts of 18 mm in diameter. Then, the steel bar was cooled to 350° C. at a cooling rate of 6° C./s, and was held at the temperature for 950 seconds to conduct austempering. After that, the steel bar was cooled to room temperature, and was treated by the Long-drilling method to drill to open a pipe hole of 9 mm in diameter in the axial direction of the steel bar, further by machining such as formation of external threads of M16 on outer periphery of the boss part, formation of a conical sheet face at top of the boss part, and drilling of a branch hole of 3 mm in diameter, thus being obtained the common rail.

Each of the fuel injection pipes of Examples 2 to 9 and each of the common rails of Examples 10 to 16 were mounted on a repeated internal pressure fatigue tester, respectively, to determine the internal pressure fatigue limit. The testing revealed that all the tested fuel injection pipes and the common rails caused no breakage thereon even under repeated application of internal pressure above 2500 Bar for over ten million cycles, exhibiting further excellent internal pressure fatigue resistance:

The fuel injection pipes of Examples 2 to 9 and the common rails of Examples 10 to 16 can further increase the internal pressure fatigue resistance by sealing a high-pressure water or a high-pressure oil therein to conduct the Autofrettage treatment after the final treatment step.

The present invention provides a high-strength steel machined product having excellent hardenability, a diesel engine fuel injection pipe and a diesel engine common rail having high strength and excellent impact resistance and internal pressure fatigue resistance, irrespective of heating temperature and processing ratio (forging processing ratio, rolling processing ratio, and the like), or the like, by obtaining an ultra-high strength low-alloy TRIP steel (TBF steel) providing high hardenability and having a metal microstructure, and having excellent balance of strength and toughness, wherein the TRIP steel is manufactured by using a steel material containing an appropriate quantity of Cr, Mo, and Ni for improving the quenchability, an appropriate quantity of one or more of Nb, Ti, and V for improving strength (fatigue strength) through the refinement of crystal grains, and having an appropriate value of carbon equivalent (Ceq), and by adopting a specified heat treatment, and the microstructure is composed of the mother-phase structure comprising mainly of lathy bainitic ferrite and a small amount of granular bainitic ferrite and polygonal ferrite, and of the secondary-phase structure comprising fine retained austenite and martensite.

What is claimed is:

1. A high-strength steel machined product having excellent hardenability, comprising: about 0.42 to 0.7% of C; 2.5% or less (excluding 0%) of Si; 0.5 to 3% of Mn; 1.5% or less of Al; 0.01 to 0.3% as the sum of one or more of Nb, Ti, and V; 2.0% or less (excluding 0%) of Cr; 0.5% or less (excluding 0%) of Mo; 2.0% or less of Ni; 0.7 to 3.0% as the sum of two or more of Cr, Mo, and Ni; 0.75 to 0.90% of carbon equivalent (Ceq) defined by the following formula $$Ceq=C+Mn/6+Si/24+Ni/40+Cr/5+Mo/4+V/14$$

and the balance of Fe and inevitable impurities, wherein the metal structure is composed of a mother-phase structure containing 50% or more (volume percentage to the entire structure) of lathy bainitic ferrite and 20% or less (volume percentage to the entire structure) as the sum of polygonal ferrite and granular bainitic ferrite, and a secondary-phase structure has 5 to 30% (volume percentage to the entire structure) of retained austenite and 5% or less (volume percentage to the entire structure) of martensite.

2. The high-strength steel machined product having excellent hardenability according to claim 1 further comprising 0.005% or less (excluding 0%) of B.

3. The high-strength steel machined product having excellent hardenability according to claim 1, wherein the machined product is a forged product.

4. The high-strength steel machined product having excellent hardenability according to claim 1, wherein the machined product is a high-pressure fuel pipe.

5. The high-strength steel machined product having excellent hardenability according to claim 4, wherein the high-pressure fuel pipe is a diesel engine fuel injection pipe having high strength and excellent impact resistance and internal pressure fatigue resistance, or a diesel engine common rail having high strength and excellent impact resistance and internal pressure fatigue resistance.

6. A method for manufacturing the high-strength steel machined product having excellent hardenability, the method comprising the steps of: providing a steel material satisfying the composition according to claim 1; holding the steel material in a first temperature range of Ac3 point or above for a specified period; subjecting the steel material to plastic working at the first temperature range; cooling the steel material to a second temperature range of 300° C. to 450° C. (preferably from 325° C. to 425° C.) at a specified average cooling rate; and holding the steel material in the second temperature range for 100 to 2000 seconds.

7. The method for manufacturing the high-strength steel machined product having excellent hardenability according to claim 6, wherein the holding time of the steel material in the first temperature range of Ac3 point or above is 1 second or more, and the average cooling rate is 1° C./s or larger.

8. A method for manufacturing a diesel engine fuel injection pipe having high strength and excellent impact resistance and internal pressure fatigue resistance, the method comprising the steps of: providing a steel material satisfying the composition according to claim 1; heating and holding the steel material at temperatures of 1200° C. or above; applying hot-extrusion to the steel material to form an extruded steel bar; holding the extruded steel bar in a temperature range of Ac3 point or above for a specified period; applying warm-extrusion to the steel bar in the temperature range of Ac3 point or above; cooling the steel bar to a temperature range of 300° C. to 450° C. at a specified average cooling rate; holding the steel bar in the temperature range of 300° C. to 450° C. for 100 to 2000 seconds; cooling the steel bar to room temperature; then performing sequentially drilling in an axial direction to form a pipe by gun-drill machining, pipe-stretching for rolling in a radial directionor in the axial direction, cutting, pipe-end machining, and bending on the pipe.

9. The method for manufacturing the diesel engine fuel injection pipe having high strength and excellent impact resistance and internal pressure fatigue resistance according to claim 8, wherein the holding time of the steel bar in the temperature range of Ac3 point or above is 1 second or more, and the average cooling rate is 1° C/s or larger.

10. A method for manufacturing a diesel engine common rail having high strength and excellent impact resistance and internal pressure fatigue resistance, the method comprising the steps of: providing a steel material satisfying the composition according to claim 1, heating and holding the steel material at temperatures of 1200° C. or above; applying hot-extrusion to the steel material to form an extruded steel bar; holding the extruded steel bar in a temperature range of Ac3 point or above for a specified period; applying warm-extrusion to the steel bar in the temperature range of Ac3 point or above; cooling the steel bar to a temperature range of 300° C. to 450° C. of 300° C. to 450° C. at a specified average cooling rate; holding the steel bar in the temperature range of 300° C. to 450° C. for 100 to 2000 seconds; cooling the steel bar to room temperature; then performing sequentially drilling in an axial direction to form a pipe by gun-drill machining, pipe-stretching for rolling in a radial direction or in the axial direction, cutting the pipe, machining the pipe, and assembling the pipes.

11. The method for manufacturing the diesel engine common rail having high strength and excellent impact resistance and internal pressure fatigue resistance according to claim 10, wherein the holding time of the steel bar in the temperature range of Ac3 point or above is 1 second or more, and the average cooling rate is 1° C/s or larger.

12. A high-strength machined high-pressure diesel engine fuel pipe comprising a steel material with a composition of: about 0.42 to 0.7% of C; 2.5% or less (excluding 0%) of Si; 0.5 to 3% of Mn; 1.5% or less of Al; 0.01 to 0.3% as the sum of one or more of Nb, Ti, and V; 2.0% or less (excluding 0%) of Cr; 0.5% or less (excluding 0%) of Mo; 2.0% or less of Ni; 0.7 to 3.0% as the sum of two or more of Cr, Mo, and Ni; 0. 75 to 0.90% of carbon equivalent (Ceq) defined by the formula:

$$Ceq=C+Mn/6+Si/24+Ni/40+Cr/5+Mo/4+V/14$$

and the balance of Fe and inevitable impurities, and with the steel material having a metal structure composed of a mother-phase structure containing 50% or more (volume percentage to the entire structure) of lathy bainitic ferrite and 20% or less (volume percentage to the entire structure) as the sum of polygonal ferrite and granular bainitic ferrite, and a second-ary-phase structure has 5 to 30% (volume percentage to the entire structure) of retained austenite and 5% or less (volume percentage to the entire structure) of martensite, the steel material being manufactured by a process that includes:

holding the steel material in a first temperature range of Ac3 point or above for a specified period;

subjecting the steel material to plastic working at the first temperature range;

cooling the steel material to a second temperature range of 300° C. to 450° C. at a specified average cooling rate; and holding the steel material in the second temperature range for 100 to 2000seconds so that the high-pressure diesel engine fuel injection pipe has excellent hardenability.

13. The high-strength machined high-pressure diesel engine fuel pipe according to claim 12, wherein the high-pressure fuel pipe is a diesel engine fuel injection pipe having high strength and excellent impact resistance and internal pressure fatigue resistance, or a diesel engine common rail having high-strength and excellent impact resistance and internal pressure fatigue resistance.

* * * * *